United States Patent [19]

Beckmann

[11] 4,027,690

[45] June 7, 1977

[54] GRAVITY-TYPE STEAM ACCUMULATOR

[75] Inventor: Georg Beckmann, Vienna, Austria

[73] Assignee: Siempelkamp Giesserei KG, Krefeld, Germany

[22] Filed: Aug. 14, 1975

[21] Appl. No.: 604,810

[30] Foreign Application Priority Data

Aug. 14, 1974 Austria ..... 6642/74

[52] U.S. Cl. ..... 137/154; 122/35

[51] Int. Cl.[2] ..... F22B 35/00

[58] Field of Search ..... 122/35; 137/206, 154

[56] References Cited

FOREIGN PATENTS OR APPLICATIONS

| | | | |
|---|---|---|---|
| 436,664 | 11/1926 | Germany | 122/35 |
| 227,325 | 1/1925 | United Kingdom | 122/35 |

*Primary Examiner*—Alan Cohan

*Attorney, Agent, or Firm*—Karl F. Ross; Herbert Dubno

[57] ABSTRACT

A steam accumulator has an upright vertically elongated vessel provided internally with a guide that subdivides a body of hot water in the vessel into an outer upflow column and a central downflow column. This guide is at least partially formed as a downwardly tapering frustocone and may have an upper portion carried on a float so as to maintain the upper edge of its upper portion a predetermined distance below the surface of a body of water within the vessel. A discharge conduit opens at the extreme upper end of the vessel and may have a section extending downwardly through the liquid body in the vessel.

1 Claim, 2 Drawing Figures

GRAVITY-TYPE STEAM ACCUMULATOR

FIELD OF THE INVENTION

The present invention relates to a steam accumulator. More particularly this invention concerns a gravity-type steam accumulator such as is usable in conjunction with a waste-heat boiler in a LD smelting process.

BACKGROUND OF THE INVENTION

A conventional steam accumulator is an upright vessel containing a body of water heated to above 100° C. Above the liquid body within the vessel there is a so-called steam space and a discharge conduit from which steam may be drawn and through which the upright vessel is charged opens at the extreme upper end of the vessel into this steam space.

A generally upright and tubular guide is provided within the vessel to subdivide the body of water therein into a central column and an annular peripheral column surrounding the central column. This guide is at least partially formed as an upwardly tapered frustocone so that the water within the vessel rises through the central column and decends in the annular outer or downcomer column.

This arrangement has the disadvantage that when the vessel is emptied rapidly the wall of the vessel will be warmer than its contents so that this wall will heat up the liquid descending in the outer column and form vapor bubbles in this outer column. These vapor bubbles impede flow considerably and make it difficult to pull dry steam out of the device. As the size of the unit is increased this problem takes on major proportions.

OBJECTS OF THE INVENTION

It is therefore an object of the present invention to provide an improved steam accumulator.

Yet another object is to provide such a steam accumulator which can be operated with a higher degree of efficiency than the hitherto known types.

SUMMARY OF THE INVENTION

These objects are attained according to the present invention in a steam accumulator of the above-described general type wherein a guide is provided which forces the body of liquid in the vessel to flow downwardly in the central column and upwardly in the outer column. This is effected by providing a generally frustoconical and downwardly tapered tube as part of the guide.

Not only does the system according to the present invention overcome the above-given disadvatages of the prior art systems, but it allows the vessel to be filled considerably more than has hitherto been obtainable. This is due to the fact that the descending central column gives the upper surface of the body of liquid in the vessel a generally upwardly concave shape, rather than convex as in the prior art, so that a centrally located discharge conduit can be spaced closer to the body without liquid entering directly into it.

According to further features of this invention the guide is formed by a lower tube fixed in the vessel and by an upper tube that can telescope vertically in or on the lower tube. A float is provided on the upper displaceable tube which has a buoyancy sufficient to maintain the upper end of this upper tube a predetermined distance below the surface of the body of water in the vessel.

According to yet another feature of this invention a filling conduit is provided having a plurality of upwardly directed nozzles angularly equispaced in the outer upflow column. Thus the proper flow pattern is established during filling of the vessel. The discharge conduit may enter the vessel well below the upper end thereof and have a section extending up through the liquid body with the upper end of the discharge conduit opening at the extreme upper end of the vessel. Thus as steam is drawn out of the vessel through this discharge conduit it is superheated as it passes down through the section of conduit provided in the liquid body.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
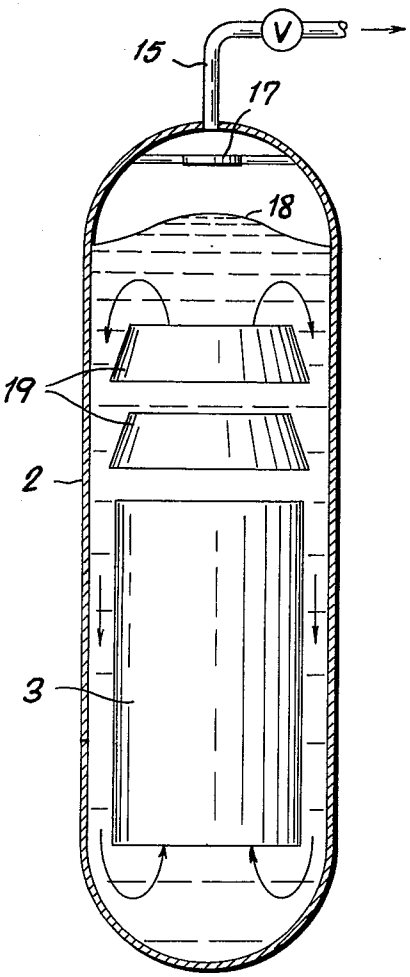
PRIOR ART FIG. 1
FIG. 1 is a vertical section through a prior art-steam accumulator.

The prior-art steam accumulators comprise as shown in FIG. 1 an upright generally cylindrical vessel 2 having hemispherical closed upper and lower ends. A discharge conduit 15 opens into the steam space at the upper end of the vessel 2. A guide 3 of generally tubular shape and having two upwardly tapered frustoconical sections 19 causes the body of water in the vessel 2 to rise centrally and descent on the outside so as to form an upwardly convex surface 18. A baffle plate 17 is provided underneath the mouth of the conduit 15 to prevent water from entering into this conduit 15.

Figure 2:
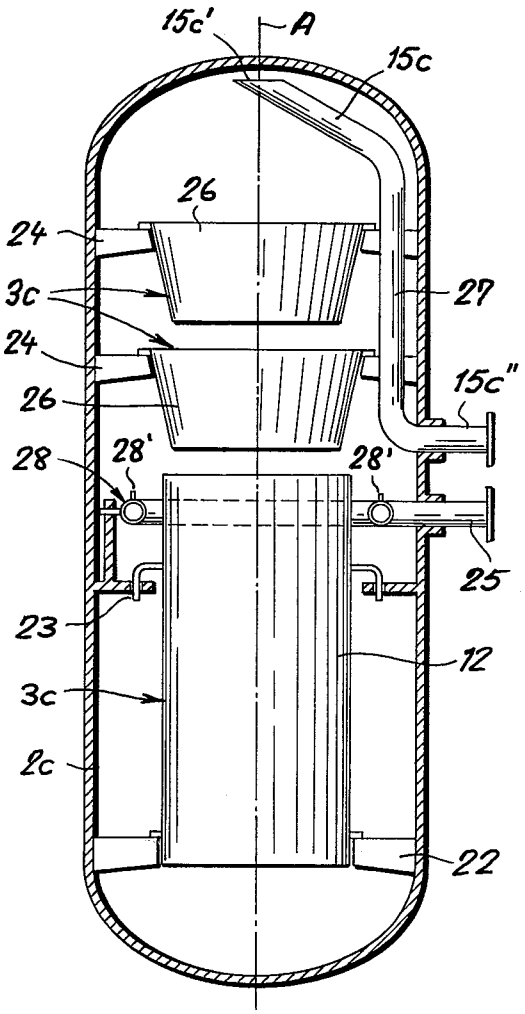
FIG. 2 is a vertical section through an accumulator according to the present invention.

The arrangement of FIG. 2 has a vessel **2*c* substantially similar to the vessel 2 and provided with a guide indicated generally at 3*c* and formed by a lower cylindrical tubular section 12 supported in the bottom by flanges 22 and at its upper portion by means of a sliding rod-and-eye arrangement 23 allowing vertical expansion of the cylinder 12. The guide 3*c* further comprises a pair of downwardly tapered frustoconical tubes 26 supported on struts 24 above the guide portion 12 and centered on the axis A of the vessel 2*c*. A discharge conduit 15*c* has a section 27 extending upwardly in the upflow column of the arrangement and having an upper end 15*c*′ opening upwardly just below the extreme upper end of the vessel 2*c*. The discharge conduit 15*c* leaves the vessel 2*c* radially at 15*c*″ adjacent the center of the vessel 2*c***.

A filling conduit 25 enters the vessel **2*c* radially adjacent the upper end of the lower portion 12 and is formed inside the vessel between the vessel and the guide section 12, that is in the upflow column, as a nozzle ring 28 having an array of upwardly directed angularly equispaced nozzles 28′. Steam or water heated above 100° C, as for instance from a waste-heat boiler of a Linz-Donau smelting process is fed into the vessel 2*c* through the conduit 25** so that the liquid or steam is originally sprayed upwardly in the upflow conduit until the vessel is filled, thereby insuring the proper flow pattern within the vessel.

The section of tube 27 descending within the upflow conduit insures that even if some water is picked up at the mouth **15*c*′ of this conduit it will be vaporized, with the section 27** acting as a superheater.

I claim:

1. A steam accumulator comprising:

a vertically elongated vessel, means for withdrawing steam from the upper end of said vessel;

a guide in said vessel subdividing same into a central downflow column and an annular upflow column surrounding said downflow column, said downflow column being of greater hydraulic diameter than said upflow column, said guide including at least one generally frustoconical downwardly tapered tube in said vessel; and a plurality of upwardly directed nozzles in said vessel outside said guide in said upflow column, and means for spraying water under pressure from said nozzles.

* * * * *